US005998351A

United States Patent [19]

Brouwer et al.

[11] Patent Number: 5,998,351

[45] **Date of Patent: *Dec. 7, 1999**

[54] DISCRETE WHITENING AGENT PARTICLES METHOD OF MAKING, AND POWDER DETERGENT CONTAINING SAME

[75] Inventors: Steven J. Brouwer, Hudsonville; Michael J. Wint, Grand Rapids, both of Mich.

[73] Assignee: Amway Corporation, Ada, Mich.

[ * ] Notice: This patent is subject to a terminal disclaimer.

[21] Appl. No.: 09/041,063

[22] Filed: Mar. 10, 1998

Related U.S. Application Data

[63] Continuation of application No. PCT/US97/03740, Mar. 10, 1997, which is a continuation-in-part of application No. 08/616,208, Mar. 15, 1996, Pat. No. 5,714,456, and a continuation-in-part of application No. 08/616,570, Mar. 15, 1996, Pat. No. 5,714,452, and a continuation-in-part of application No. 08/616,217, Mar. 15, 1996, Pat. No. 5,714,450.

[51] Int. Cl.[6] ..... C11D 3/42; C11D 11/00; C11D 17/06

[52] U.S. Cl. ..... 510/324; 510/326; 510/351; 510/356; 510/394; 510/444; 510/461; 510/509; 8/648; 252/301.23

[58] Field of Search ..... 510/326, 356, 510/351, 509, 324, 394, 444, 461; 8/648; 252/301.23

[56] References Cited

U.S. PATENT DOCUMENTS

| | | |
|---|---|---|
| 2,791,564 | 5/1957 | Fleck . |
| 3,446,893 | 5/1969 | Hanford et al. . |
| 3,522,185 | 7/1970 | Hausermann et al. . |
| 3,579,455 | 5/1971 | Sabatelli et al. . |
| 3,597,361 | 8/1971 | Sumner . |
| 3,627,686 | 12/1971 | Sabatelli et al. . |
| 3,664,961 | 5/1972 | Norris . |
| 3,684,744 | 8/1972 | Shen et al. . |
| 3,700,599 | 10/1972 | Mizuno et al. . |
| 3,726,813 | 4/1973 | Borrello . |
| 3,761,415 | 9/1973 | Gould . |
| 3,764,559 | 10/1973 | Mizuno et al. . |
| 3,769,222 | 10/1973 | Yurko et al. . |
| 3,799,880 | 3/1974 | Kelly et al. . |
| 3,801,511 | 4/1974 | Lemoff . |
| 3,824,189 | 7/1974 | Borello . |
| 3,846,346 | 11/1974 | Conn . |
| 3,850,852 | 11/1974 | Neillie et al. . |
| 3,886,098 | 5/1975 | DiSalvo et al. . |
| 3,896,056 | 7/1975 | Benjamin et al. . |
| 3,904,685 | 9/1975 | Shahidi et al. . |
| 3,922,230 | 11/1975 | Lamberti et al. . |
| 3,933,670 | 1/1976 | Brill et al. . |
| 3,933,673 | 1/1976 | Davies . |
| 3,950,260 | 4/1976 | Eldib . |
| 3,950,275 | 4/1976 | Toyoda et al. . |
| 3,962,149 | 6/1976 | Chirash et al. . |
| 3,993,574 | 11/1976 | Christ et al. . |
| 4,049,467 | 9/1977 | Rubin . |
| 4,051,054 | 9/1977 | Davies et al. . |
| 4,059,538 | 11/1977 | Green et al. . |
| 4,098,713 | 7/1978 | Jones . |
| 4,125,475 | 11/1978 | Kolaian et al. . |
| 4,140,650 | 2/1979 | Wilde . |
| 4,142,044 | 2/1979 | Günther et al. . |
| 4,196,093 | 4/1980 | Clarke et al. . |
| 4,203,858 | 5/1980 | Chakrabarti . |
| 4,210,550 | 7/1980 | Cornelissens . |
| 4,222,905 | 9/1980 | Cockrell, Jr. . |
| 4,239,659 | 12/1980 | Murphy . |
| 4,248,911 | 2/1981 | Wixon . |
| 4,294,711 | 10/1981 | Hardy et al. . |
| 4,294,718 | 10/1981 | Kaeser . |
| 4,298,490 | 11/1981 | Lange et al. . |
| 4,298,493 | 11/1981 | Schreiber . |
| 4,309,316 | 1/1982 | Lange et al. . |
| 4,311,606 | 1/1982 | Kaeser . |
| 4,311,607 | 1/1982 | Kaeser . |
| 4,326,971 | 4/1982 | Wixon . |
| 4,362,640 | 12/1982 | Schreiber . |
| 4,407,722 | 10/1983 | Davies et al. . |
| 4,411,803 | 10/1983 | Wixon . |
| 4,411,809 | 10/1983 | Wixon . |
| 4,416,809 | 11/1983 | Magari et al. . |
| 4,441,881 | 4/1984 | Ruppert et al. . |
| 4,444,674 | 4/1984 | Gray . |
| 4,457,854 | 7/1984 | Gangwisch et al. . |
| 4,473,485 | 9/1984 | Greene . |
| 4,478,598 | 10/1984 | Meyer et al. . |

(List continued on next page.)

FOREIGN PATENT DOCUMENTS

| | | |
|---|---|---|
| 0110588 | 6/1984 | European Pat. Off. . |
| 0578872 | 1/1994 | European Pat. Off. . |
| 2267911 | 12/1993 | United Kingdom . |

OTHER PUBLICATIONS

Prieto et al., United States Statutory Invention Registration, Reg. No. H1467, Publication Date: Aug. 1, 1995.

*Primary Examiner*—Lorna M. Douyon
*Attorney, Agent, or Firm*—G. Peter Nichols; Brinks Hofer Gilson & Lione

[57] ABSTRACT

A powdered laundry detergent is provided with discrete whitening agent particles that do not adversely affect the bulk appearance of the detergent during storage. The detergent includes from about 5% to about 80% of an inorganic carrier, from about 1% to about 90% of a detergent surfactant, and from 0.1% up to about 30% of the discrete whitening agent particles. The whitening agent particles include a whitening agent and a surfactant. The surfactant for the whitening agent particle includes those anionics, nonionics, zwitterionics, ampholytics, cationics, and mixtures thereof that are solids in a temperature range of from about 32° F. (0° C.) to about 180° F. (82° C.). The whitening agent particles, in a more desirably form, include a whitener and water. The particles are formed by extruding a homogenous mass into discrete particles. The homogenous mass includes either a whitening agent, a surfactant, and optionally a plasticizer or a whitening agent and water.

16 Claims, No Drawings

U.S. PATENT DOCUMENTS 4,524,013 6/1985 Lamberti .
4,557,853 12/1985 Collins .
4,589,989 5/1986 Müller et al. .
4,612,137 9/1986 Kuroda et al. .
4,652,391 3/1987 Balk .
4,666,740 5/1987 Wixon .
4,720,399 1/1988 Taha .
4,741,851 5/1988 Borrello .
4,818,424 4/1989 Evans et al. .
4,820,441 4/1989 Evans et al. .
4,853,259 8/1989 Taha .
4,857,223 8/1989 Borrello .
4,863,626 9/1989 Coyne et al. .
4,869,843 9/1989 Saito et al. .
4,900,466 2/1990 Atkinson et al. .
4,919,847 4/1990 Barletta et al. .
4,923,628 5/1990 Appel et al. .
4,931,203 6/1990 Ahmed et al. .
4,933,100 6/1990 Ramachandran .
4,954,292 9/1990 Hull et al. .
4,970,017 11/1990 Nakamura et al. .
4,992,079 2/1991 Lutz .
5,002,758 3/1991 Ichii et al. .
5,030,377 7/1991 Sone et al. .
5,030,379 7/1991 Knight et al. .
5,057,236 10/1991 Petrin et al. .
5,073,295 12/1991 Bruttel et al. .
5,082,578 1/1992 Langer et al. .
5,091,106 2/1992 Jacobs et al. .
5,133,924 7/1992 Appel et al. .
5,164,108 11/1992 Appel et al. .
5,198,144 3/1993 Ichii et al. .
5,225,100 7/1993 Fry et al. .
5,259,994 11/1993 Welch et al. .
5,300,250 4/1994 Morgan et al. .
5,312,561 5/1994 Hoshino et al. .
5,312,748 5/1994 Liu et al. .
5,314,637 5/1994 Saito et al. .
5,338,476 8/1994 Pancheri et al. .
5,415,806 5/1995 Pepe et al. .
5,458,799 10/1995 Flower .
5,468,416 11/1995 Outtrup et al. .
5,468,516 11/1995 Yamashita et al. .
5,470,509 11/1995 Pancheri .
5,496,486 3/1996 Staley .
5,714,451 2/1998 Brouwer et al. ..... 510/324
5,714,452 2/1998 Brouwer ..... 510/394

DISCRETE WHITENING AGENT PARTICLES METHOD OF MAKING, AND POWDER DETERGENT CONTAINING SAME

This application is a continuation of PCT/US97/03740 filed Mar. 10, 1997, which is a continuation-in-part of U.S. Ser. No. 08/616,208 filed on Mar. 15, 1996, now U.S. Pat. No. 5,714,456 Ser. No. 08/616,570 filed on Mar. 15, 1996 now U.S. Pat. No. 5,714,452 and Ser. No. 08/616,217 filed on Mar. 16, 1996 now U.S. Pat. No. 5,714,450, each of which is incorporated herein by reference in their entirety.

BACKGROUND OF THE INVENTION

The present invention relates to whitening agent particle compositions, more particularly, to whitening agent compositions in the form of discrete particles, to the process for making them. In this regard, U.S. applications Ser. No. 08/616,570 now U.S. Pat. No. 5,714,452; Ser. No. 08/616,208 now U.S. Pat. No. 5,714,456; are hereby incorporated by reference in their entirety. The whitening agent particle compositions made by the process described below are suitable for admixture with powder laundry detergents, bleaching powders and other powder laundry products. Thus, the present invention also relates to a powder detergent containing discrete whitening agent particles.

It is known to add whitening agents to washing detergents in order to enhance the whiteness and brightness of the washed textiles. In particular, fluorescent whitening agents (FWAs) counteract the yellowing of cotton and synthetic fibers. FWAs are adsorbed on fabrics during the washing process. FWAs function by absorbing ultraviolet light, which is then emitted as visible light, generally in the blue wavelength ranges. The resultant light emission yields a brightening an whitening effect, which counteracts yellowing or dulling of the fabric. If, however, the whitener, particularly a fluorescent whitener, is incorporated in powdered detergents in the customary manner, they have an exceedingly undesirable drawback. Frequently, they cause a deterioration in the bulk appearance of the detergent. Unattractive, yellow or greenish-yellow powders of reduced commercial value are produced. Without being bound by any particular theory, it is believed that the whitening agents react with the detergent surfactants causing the agent to change forms and thereby cause the bulk appearance of the detergent to change. This reaction appears to be particularly prevalent when the detergent contains a substantial amount of nonionic surfactant.

One solution that has been proposed is to select a fluorescent whitening agent that may be more stable in a detergent containing a high nonionic surfactant concentration. The drawback to such whitening agents is that they lack cold water performance and they are expensive.

Another solution that has been proposed is reported in U.S. Pat. Nos. 4,298,490 and 4,309,316 to Lange et al. In these patents, a fluorescent whitener such as a bis-styrylbiphenyl, a bis-triazoylstilbene or naphthotriazolylstilbene type, is dissolved or dispersed in a mixture of water and a polymer (polyvinyl alcohol or polyvinyl pyrrolidone) and then added to the detergent slurry which is then later dried. Alternatively, the whitener solution or dispersion may be spray dried, suspended in water, added to the detergent slurry and then spray dried. These methods, however, require many processing steps prior to incorporation into a detergent slurry. Therefore, there is a need for a powder detergent that contains a whitening agent and which does not suffer from discoloration of the bulk detergent upon storage.

It has now been discovered that a whitening agent composition can be formed into discrete particles so that they can advantageously be added to, for example, a powder detergent composition.

SUMMARY OF THE INVENTION

It has now been discovered that the problem of bulk appearance discoloration, caused by degradation of the whitening agent, can be alleviated by forming the whitening agent such that it is in the form of a discrete particle according to the method of the present invention. By forming the whitening agent into discrete particles, the intimate interaction between the whitener and the detergent ingredients is minimized and consequently, the degradation in the bulk appearance of the detergent is minimized, if not substantially alleviated.

The whitening agent (or whitener) particles can then be added to the bulk detergent in the normal manner, preferably after any drying step. By forming the whitening agent as a discrete particle, the intimate interaction between the whitener and the detergent ingredients is minimized and consequently, the degradation in the bulk appearance of the detergent is minimized, if not substantially prevented. In one form of the invention, the whitening agent particles comprise a whitener and a surfactant. Preferably, the surfactant is compatible with the detergent surfactants and is selected from the group consisting of those anionics, nonionics, zwitterionics, ampholytics, cationics, and mixtures thereof that are solids in a temperature range of from about 32° F. (0° C.) to about 180° F. (82° C.). In another and more preferred form, the whitening agent particles comprise a whitener, a surfactant, preferably an anionic surfactant, and water, as a plasticizer.

The invention also encompasses incorporating discrete whitening agent particles, made according to the process of the present invention, in powdered laundry detergents. The laundry detergent of the present invention comprises, by weight, from about 5% to about 80% of an inorganic carrier; from about 1% to about 90% of a detergent surfactant selected from the group consisting of anionics, nonionics, zwitterionics, ampholytics, cationics, and mixtures thereof; and from about 0.1% up to about 30% of whitening agent particles.

The whitening agent particles include a whitener (or whitening agent) and a surfactant or more preferably, a whitener, a surfactant, and water in the form a discrete particle. The whitening agent can be any known fluorescent whitener. Preferably, the whitener is selected from the fluorescent whitening agents selected from the coumarins, diaminostilbenedisulfonic acids, diaminostilbenesulfonic acid-cyanuric chlorides, distyrylbiphenyls, naphthotriazoylstilbenes, pyrazolines and mixtures thereof.

The composition of the present invention, in one form, relates to a whitening agent particle composition comprising a whitener (or whitening agent) and a surfactant that substantially completely isolates or protects the whitening agent. The composition may optionally include a plasticizer to provide a softer or more pliable particle. The composition is preferably in the form of a particle. The whitening agent particles comprise from about 50% to about 95% of a surfactant, from about 1% to about 50% of a whitener and, optionally from about 0.1% up to about 10% of a plasticizer wherein the surfactant is mixed with the whitener in a ratio of surfactant to whitening agent from about 1:1 to about 50:1, preferably from about 1:1 to about 25:1. It is believed that by providing at least an equal amount of surfactant and whitening agent the surfactant will substantially isolate or protect the whitening agent.

The process of preparing the discrete whitening agent particles effectively renders the whitening agent substantially resistant to degradation yet allows for sufficient solubility upon introduction into an aqueous medium, such as found during laundering. The process includes the steps of providing a whitening agent, admixing a surfactant that is a solid in a temperature range of from about 32° F. (0° C.) to about 180° F. (82° C.) with the whitening agent to form a substantially homogenous mass, and forming the mixture into discrete particles. The process may also include the step of mixing a plasticizer with the whitening agent and surfactant to produce a particle that is more pliable. In addition, various detergent ingredients may be incorporated as adjuncts so long as they do not deter from the sought after advantage resulting from forming the whitening agent into a discrete particle. The whitening agent is admixed with a surfactant and the resulting mixture is extruded through a die slot into discrete particles. In this preferred embodiment, the mixture is extruded through, for example, a screw type extruder. Although the die slot and therefore the extrudate may take any suitable shape, it has been found that a spaghetti shape provides the desired protection for the whitening agent yet allows the resulting particle to dissolve or disperse in an aqueous medium such as a laundry solution. When the extrudate takes the form of spaghetti, the extruder die hole diameter is preferably in the range of about 0.1 mm to about 5 mm. In addition, the average length of the resulting spaghetti particles ranges from about 0.1 mm to about 30 mm with about 95% thereof within a tolerance of about 0.5 mm to about 20 mm.

In a more preferred embodiment, the process of making the particles includes providing a whitening agent, a surfactant, particularly an anionic surfactant, and a plasticizer, particularly water and forming the mixture into discrete particles.

The whitening agent particles may be incorporated into detergent compositions such as those produced by spray-drying, agglomerating, and other well known methods. For example, the spray drying process involves mixing detergent components including surfactants and builders with water to form a slurry which is then sprayed into a high temperature air stream to evaporate excess water and to form bead-type hollow particles. In this method, the whitener particles can be added to the spray dried detergent composition after the excess water has been removed.

Alternatively, some methods of making detergent compositions contemplate the addition of binders to agglomerate the powder particles. Typically, premixed ingredients are tumbled in a large drum while binder solution is sprayed onto the tumbling particles. The agglomerate is then dried to remove the excess water. In this method, the whitener particles can be added to the agglomerated composition after the water removal step.

Although it is contemplated that the detergent composition can be formulated in any known manner with known surfactants, it is believed that the incorporation of the whitening agent particles described in the following specification will find particular use in those detergents containing a substantial amount of nonionic surfactants. Therefore, in a more preferred embodiment, the laundry detergent of the present invention comprises a detergent premix that comprises from about 5% to about 80%, preferably from about 20% to about 70%, and more preferably, from about 30% to about 60% of an inorganic carrier and from about 1% to about 90%, preferably from about 10% to about 50%, and more preferably from about 20% to about 40% of a detergent surfactant selected from the group consisting of nonionic surfactants, wherein the nonionic surfactant is the sole detergent surfactant present in the detergent premix, and from about 0.1% up to about 30%, preferably up to about 15%, and more preferably up to about 5%, of discrete whitening agent particles wherein the whitening agent particles comprise a whitener and a surfactant. Desirably, in this more preferred embodiment, the inorganic carrier is sodium carbonate and the nonionic surfactant is an ethoxylated alcohol.

The term "coated" is used in the following specification and claims to mean that the surfactant is present on the surface of the carbonate as well as within carbonate particle (e.g. by absorption).

The present invention also contemplates a method of making a powder detergent that comprises the steps of providing a powder laundry detergent that comprises from about 5% to about 80% of an inorganic carrier and from about 1% to about 90% of a detergent surfactant selected from the group consisting of anionics, nonionics, ampholytics, cationics, and mixtures thereof; admixing from about 0.1% up to about 30% of discrete whitening agent particles. Preferably, the method comprises the steps of providing a powder laundry detergent that comprises from about 20% to about 70% of an inorganic carrier and from about 10% to about 50% of a detergent surfactant selected from the group consisting of anionics, nonionics, ampholytics, cationics, and mixtures thereof; admixing discrete whitening agent particles in an amount from about 0.1% up to about 15%.

More preferably, the method of making the powder detergent containing discrete whitener particles comprises providing an agglomerated powder laundry detergent that comprises a detergent premix that includes from about 5% to about 80%, preferably from about 20% to about 70%, and more preferably from about 30% to about 60% of sodium carbonate, and from about 1% to about 90% preferably from about 10% to about 50% and more preferably from about 20% to about 40% of a detergent surfactant selected from the group consisting of nonionic surfactants, wherein the nonionic surfactant is the sole detergent surfactant present in the detergent premix; admixing from about 0.1% up to about 30%, preferably up to about 15%, and more preferably up to about 5%, of discrete whitening agent particles wherein the whitening agent particles comprise a whitener and a surfactant and more preferably the particles comprise a whitener, a surfactant and water.

Unless specifically noted otherwise, all percentages used in the specification and appended claims are by weight.

DETAILED DESCRIPTION OF THE INVENTION AND PREFERRED EMBODIMENTS

The present invention relates to a whitening agent particle composition, a method of making it, and a powder detergent containing the whitening agent particle composition. The whitening agent particle composition comprises, in one form, a whitener (or whitening agent) and a surfactant that substantially completely protects or isolates the whitening agent. The composition may optionally include an amount of a plasticizer to provide for a more pliable end product. In another, more desirable form, the particle composition consists of a whitening agent, a surfactant, and water such that the composition is in the form of a particle to substantially protect the whitening agent from degradation.

The whitening agents suitable for use in the present invention include the known fluorescent whitening agents. For example, it is believed that the whiteners disclosed in U.S. Pat. Nos. 4,294,711, 5,225,100, 4,298,490, 4,309,316, 4,411,803, 4,142,044, and 4,478,598 each incorporated herein by reference, may be useful in the present invention. Preferably, the whitening agent is selected from the group of fluorescent whitening agents consisting of coumarins, stilbenes, diaminostilbenedisulfonic acids, diaminostilbenesulfonic acid-cyanuric chlorides, distyrylbiphenyls, naphthotriazoylstilbenes, pyrazolines, and mixtures thereof.

As noted above, the present invention is directed to powder detergent compositions that contain post-added discrete whitening agent particles. The term post-added refers to the addition of the particles after any substantial moderate to high temperature step such as, for example, drying. The powder laundry detergent contains an inorganic carrier, a detergent surfactant, and, optionally, other known detergent adjuncts.

The inorganic carrier can be present in the detergent composition in an amount of about 5% to about 80% by weight of the final product. Generally, the amount of inorganic carrier present in the final product is balanced against the amount of surfactant present. The inorganic carrier is preferably included in an amount from about 20% to about 70% by weight of the final product. More preferably, the inorganic carrier is present in the range from about 30% to about 60% by weight of the final composition.

Suitable inorganic carriers are preferably builders that are also capable of binding or precipitating the salts responsible for hardness in water. The builders herein include any of the conventional inorganic and organic water-soluble builder salts. Such builders can be, for example, water-soluble salts of phosphates including tripolyphosphates, pyrophosphates, orthophosphates, higher polyphosphates, carbonates, silicas, silicates, and organic polycarboxylates. Specific preferred examples of inorganic phosphate builders include sodium and potassium tripolyphosphates and pyrophosphates.

The inorganic carrier preferably contains little (e.g., less than 10%, preferably less than 5%, by weight) or no phosphate builder materials. Consequently, the nonphosphorous-containing materials are preferred and include the alkali metal, e.g., sodium and potassium, carbonates, and silicas. Other suitable carriers will be evident to those skilled in the art. For example, aluminosilicate ion exchange materials may be useful in the detergent composition of this invention and may include the naturally-occurring aluminosilicates or synthetically derived. A method for producing aluminosilicate ion exchange materials is discussed in U.S. Pat. No. 3,985,669, incorporated herein by reference. Such synthetic crystalline aluminosilicate ion exchange materials are available under the designations Zeolite A, Zeolite B, and Zeolite X. In addition, layered or structured silicates such as those sold under the designation SKS-6 by Hoechst-Celanese, may also find use in the detergent composition.

Preferably, the inorganic carrier is an alkali metal carbonate that may include minor amounts of other suitable carriers. Among the alkali metal carbonates useful in the laundry detergent of the present invention are light density (LT) soda ash (Solvay process), mixtures of light density (LT) and medium density soda ash (Sesquicarbonate process), a special high porosity "medium-light" ash (Sesquicarbonate process) and mixtures of light density and "medium-light" ash. These particles of sodium carbonate have an average density of from about 0.5 to about 0.7 and an average mesh size ranging from about 20 to about 200, U.S. Standard Sieve number. Carbonates such as these are commercially available from FMC Corp. and General Chemical and are relatively inexpensive as compared to more processed carbonates because they do not require further processing such as grinding.

The detergent surfactant is selected from the group consisting of anionics, nonionics, zwitterionics, ampholytics, cationics, and mixtures thereof. The detergent surfactant used in the present invention may be any of the conventional materials of this type which are very well known and fully described in the literature, for example in "Surface Active Agents and Detergents" Volumes I and II by Schwartz, Perry & Berch, in "Nonionic Surfactants" by M. J. Schick, and in McCutcheon's "Emulsifiers & Detergents," each of which are incorporated herein in their entirety by reference. In the preferred embodiment, where the powder detergent is made by agglomerating, the surfactant is a nonionic surfactant. The surfactant is present at a level of from about 1% to about 90%. Desirably, the surfactant is present at a level of from about 10% to about 50%, and preferably, the surfactant is included in an amount from about 20% to about 40%.

Useful anionic surfactants include the water-soluble salts of the higher fatty acids, i.e., soaps. This includes alkali metal soaps such as the sodium, potassium, ammonium, and alkyl ammonium salts of higher fatty acids containing from about 8 to about 24 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 8 to about 20 carbon atoms and a sulfonic acid or sulfuric acid ester group. Included in the term "alkyl" is the alkyl portion of acyl groups. Examples of this group of synthetic surfactants are the sodium and potassium alkyl sulfates, especially those obtained by sulfating the higher primary or secondary alcohols ($C_8$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. No. 2,220,099 and alkylbenzene sulfonates in which the average number of carbon atoms in the alkyl group is from about 11 to 14, abbreviated as $C_{11-14}$ LAS.

The anionic surfactants useful in the present invention may also include the potassium, sodium, calcium, magnesium, ammonium or lower alkanolammonium, such as triethanolammonium, monoethanolammonium, or diisopropanolammonium paraffin or olefin sulfonates in which the alkyl group contains from about 10 to about 20 carbon atoms. The lower alkanol of such alkanolammonium will normally be of 2 to 4 carbon atoms and is preferably ethanol. The alkyl group can be straight or branched and, in addition, the sulfonate is preferably joined to any secondary carbon atom, i.e., the sulfonate is not terminally joined.

The anionic surfactants useful in the present invention may also include the potassium, sodium, calcium, magnesium, ammonium or lower alkanolammonium, such as triethanolammonium, monoethanolammonium, or diisopropanolammonium paraffin or olefin sulfonates in which the alkyl group contains from about 10 to about 20 carbon atoms. The lower alkanol of such alkanolammonium will normally be of 2 to 4 carbon atoms and is preferably ethanol. The alkyl group can be straight or branched and, in addition, the sulfonate is preferably joined to any secondary carbon atom, i.e., the sulfonate is not terminally joined.

Other anionic surfactants that may be useful in the present invention include the secondary alkyl sulfates having the general formula

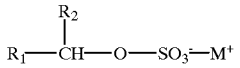

wherein M is potassium, sodium, calcium, or magnesium, $R_1$ represents an alkyl group having from about 3 to about 18 carbon atoms and $R_2$ represents an alkyl group having from about 1 to about 6 carbon atoms. Preferably, M is sodium, $R_1$ is an alkyl group having from about 10 to about 16 carbon atoms, and $R_2$ is an alkyl group having from about 1 to about 2 carbon atoms.

Other anionic surfactants useful herein are the sodium alkyl glycerol ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl group contains from about 10 to about 20 carbon atoms.

The ether sulfates useful in the present invention are those having the formula $RO(C_2H_4O)_xSO_3M$ wherein R is alkyl or alkenyl having from about 10 to about 20 carbon atoms, x is 1 to 30, and M is a water-soluble cation preferably sodium. Preferably, R has 10 to 16 carbon atoms. The alcohols can be derived from natural fats, e.g., coconut oil or tallow, or can be synthetic. Such alcohols are reacted with 1 to 30, and especially 1 to 12, molar proportions of ethylene oxide and the resulting mixture of molecular species is sulfated and neutralized.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Another example of anionic surfactants that may be useful in the present invention are those compounds that contain two anionic functional groups. These are referred to as di-anionic surfactants. Suitable di-anionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyldisulfates and 6,10-octadecyldisulfates.

The nonionic surfactant is preferably liquid at normal processing temperatures, i.e., at temperatures form about 25 to about 50° C. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, the nonionic surfactants may include the polyoxyethylene or polyoxypropylene condensates of aliphatic carboxylic acids, whether linear or branched chain and unsaturated or saturated, containing from about 8 to about 18 carbon atoms in the aliphatic chain and incorporating from about 5 to about 50 ethylene oxide or propylene oxide units. Suitable carboxylic acids include "coconut" fatty acid which contains an average of about 12 carbon atoms, "tallow" fatty acid which contains an average of about 18 carbon atoms, palmic acid, myristic acid, stearic acid, and lauric acid.

The nonionic surfactants can also include polyoxyethylene or polyoxypropylene condensates of aliphatic alcohols, whether linear or branched chain and unsaturated or saturated, containing from about 8 to about 24 carbon atoms and incorporating from about 5 to about 50 ethylene oxide or propylene oxide units. Suitable alcohols include the coconut fatty alcohol, tallow fatty alcohol, lauryl alcohol, myristyl alcohol, and oleyl alcohol.

Preferred nonionic surfactants are of the formula $R^1(OC_2H_4)_nOH$, where $R^1$ is a $C_8$–$C_{16}$ alkyl group or a $C_8$–$C_{12}$ alkyl phenyl group, and n is from 3 to about 80. Particularly preferred nonionic surfactants are the condensation products of $C_{12}$–$C_{16}$ alcohols with from about 5 to about 20 moles of ethylene oxide per mole of alcohol, e.g., a $C_{12}$–$C_{15}$ alcohol condensed with about 6 to about 9 moles of ethylene oxide per mole of alcohol. Nonionic surfactants of this type include the NEODOL™ products, e.g., Neodol 23-6.5, Neodol 25-7, Neodol 25-9 which are, respectively, $C_{12-13}$ linear primary alcohol ethoxylate having 6.5 moles of ethylene oxide, $C_{12-15}$ linear primary alcohol ethoxylate having 7 moles of ethylene oxide, and $C_{12-15}$ linear primary alcohol ethoxylate having 9 moles of ethylene oxide.

Alkyl saccharides may also find use in the composition. In general, the alkyl saccharides are those having a hydrophobic group containing from about 8 to about 20 carbon atoms, preferably from about 10 to about 16 carbon atoms, and a polysaccharide hydrophillic group containing from about 1 (mono) to about 10 (poly), saccharide units (e.g., galactoside, glucoside, fructoside, glucosyl, fructosyl, and/or galactosyl units). Mixtures of saccharide moieties may be used in the alkyl saccharide surfactants. Preferably, the alkyl saccharides are the alkyl glucosides having the formula $$R^1O(C_NH_{2N}O)_t(Z)_X$$

wherein Z is derived from glucose, $R^1$ is a hydrophobic group selected from the group consisting of alkyl, alkyl-phenyl, hydroxyalkyl, hydroxyalkylphenyl, and mixtures thereof in which the alkyl groups contain from about 10 to about 18 carbon atoms, n is 2 or 3, t is from 0 to about 10, and x is from 1 to about 8. Examples of such alkyl saccharides are described in U.S. Pat. No. 4,565,647 (at col. 2, line 25 through col. 3, line 57) and U.S. Pat. No. 4,732,704 (at col. 2, lines 15–25), the pertinent portions of each are incorporated herein by reference.

Semi-polar nonionic surfactants include water-soluble amine oxides containing one alkyl moiety of from about 10 to 18 carbon atoms and two moieties selected from the group of alkyl and hydroxy alkyl moieties of from about 1 to about 3 carbon atoms; water-soluble phosphine oxides containing one alkyl moiety of about 10 to 18 carbon atoms and two moieties selected from the group consisting of alkyl groups and hydroxy alkyl groups containing from about 1 to 3 carbon atoms; and water-soluble sulfoxides containing one alkyl moiety of from about 10 to 18 carbon atoms and a moiety selected from the group consisting of alkyl and hydroxy alkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

The powder detergent composition may optionally contain other well known adjuncts for detergent compositions. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. Such ingredients are described in, for example, U.S. Pat. No. 3,936,537, incorporated herein by reference.

Water-soluble, organic builders may also find use in the detergent composition of the present invention. For example, the alkali metal, polycarboxylates such as sodium and potassium, salts of ethylenediaminetetraacetic acid, nitrilotriacetic acid, oxydisuccinic acid, mellitic acid, benzene polycarboxylic acid, polyacrylic acid, and polymaleic acid may be included.

Other polycarboxylate builders are the builders set forth in U.S. Pat. No. 3,308,067, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. Nos. 4,144,226, and 4,246,495, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Bleaching agents and activators that may find use in the present detergent composition are described in U.S. Pat. Nos. 4,412,934, and 4,483,781, both of which are incorporated herein by reference. Suitable bleach compounds include sodium perborate, sodium percarbonate, etc. and the like, and mixtures thereof. The bleach compounds may also be used in combination with an activator such as, for example, tetra-acetyl-ethylenediamine (TAED), sodium nonanoyloxybenzene sulfonate (SNOBS), diperoxydodecanedioc acid (DPDDA) and the like, and mixtures thereof. Chelating agents are described in U.S. Pat. No. 4,663,071, from column 17, line 54 through column 18, line 68, incorporated herein by reference. Suds modifiers are also optional ingredients and are described in U.S. Pat. Nos. 3,933,672, and 4,136,045, both incorporated herein by reference.

Smectite clays may be suitable for use herein and are described in U.S. Pat. No. 4,762,645, at column 6, line 3 through column 7, line 24, incorporated herein by reference. Other suitable additional detergency builders that may be used herein are enumerated in U.S. Pat. No. 3,936,537, column 13, line 54 through column 16, line 16, and in U.S. Pat. No. 4,663,071, both incorporated herein by reference.

The detergent composition may also contain a post-added acidulant to improve the solubility of the laundry detergent powder as more particularly described in U.S. application Ser. No. 08/617,941 now abandoned, incorporated herein by reference.

The laundry detergent compositions of the present invention can be formulated to provide a pH (measured at a concentration of 1% by weight in water at 20° C.) of from about 7 to about 11.5. A pH range of from about 9.5 to about 11.5 is preferred for best cleaning performance.

In a preferred embodiment, the nonionic surfactant is the sole detergent surfactant and is included in the detergent composition in an amount of about 1% to about 90% by weight of the final product. Of course, the detergent benefits of a high nonionic surfactant concentration must be balanced against cost-performance. Therefore, the preferred range for the nonionic surfactants is from about 10% to about 50% by weight of the final product, more preferably from about 20% to about 40% by weight of the final product.

The powder detergent composition may be produced by any of the well known methods. For example, the powder detergent may be produced by spray drying as disclosed in U.S. Pats. Nos. 5,338,476 and 5,415,806, each incorporated herein by reference in their entirety. The detergent composition may also be prepared by agglomerating as set forth in U.S. Pat. Nos. 4,473,485, 5,164,108 and 5,458,799, each incorporated herein by reference in their entirety.

In one embodiment, the powder detergent may be made by the method fully described in U.S. Pat. No. 5,496,486 the entire disclosure of which is incorporated herein by reference.

In a preferred embodiment, the detergent composition is an agglomerated powder detergent containing an alkali metal carbonate loaded with a surfactant as more particularly described in U.S. application Ser. No. 08/616,568 now abandoned, and is made by the process disclosed in U.S. patent application Ser. No. 08/616,443 now abandoned.

In this preferred embodiment, the detergent composition comprises three essential ingredients: sodium carbonate, a surfactant and a substantially completely neutralized carboxylic acid. Preferably, the surfactant is a nonionic surfactant.

Among the preferred sodium carbonates are those described above. The sodium carbonate can be present in an amount of about 5% to about 80% by weight of the final product. The amount of sodium carbonate added to the final product is balanced against the amount of nonionic surfactant which will be loaded into the sodium carbonate as well as the amount which will be neutralized by the admixed carboxylic acid. The preferred range for the sodium carbonate is from about 20% to about 70%, more preferably from about 30% to about 65% by weight of the final product. It should be mentioned that within the preferred range the higher levels tend to be required under conditions of use at low product concentrations, as is commonly the practice in North America, and the converse applies under conditions of use at higher product concentrations, as tends to occur in Europe.

If desired, the sodium carbonate can be mixed with other minor amounts, not to exceed about 10% of the final product, of detergent ingredients before the nonionic surfactant is added to it. The order of addition is not critical so long as the carbonate is adequately coated with the surfactant. For example, the carbonate, optional detergent ingredients, and surfactant may be mixed in the manner fully disclosed in U.S. Pat. Nos. 5,458,769 or 5,496,486, the entire disclosure of both are incorporated herein by reference.

In another embodiment, a minor amount, up to about 5%, of a silica such as a silicon dioxide hydrate is mixed with the sodium carbonate prior to loading with the nonionic surfactant. A variety of siliceous substances are acceptable for addition to the detergent composition, although highly absorbent silica of the precipitated or fumed variety is preferred. The preferred siliceous compounds have oil absorption numbers of 150 to about 350 or greater, preferably about 250 or greater. As examples of operable silicas, the following siliceous material are representative: Sipernat 50, Syloid 266, Cabosil M-5, Hisil 7-600. Preferably, from about 0.5% to about 4% by weight of the final product, of silica is mixed with the sodium carbonate prior to loading by the nonionic surfactant. More preferably, from about 3% to about 4% of silica by weight of the final product is mixed with the sodium carbonate.

Low levels of carboxymethylcellulose, for example up to about 5%, to aid in the prevention of soil suspended in the wash liquor from depositing onto cellulosic fabrics such as cotton, may also be mixed with the sodium carbonate prior to loading with the nonionic surfactant. Preferably, from about 1% to about 3%, more preferably from about 2% to about 3% of carboxymethylcellulose is mixed with the sodium carbonate prior to loading with the nonionic surfactant. In a preferred embodiment, both the silica and the carboxymethylcellulose are mixed with the sodium carbonate prior to being loaded with the nonionic surfactant.

The second essential ingredient is a detergent surfactant which may be any of the surfactants described above. Although the preferred surfactant is a nonionic surfactant, it is to be understood that any of the surfactants described above can be used individually or in combination. Thus, while the description below refers to nonionic surfactants, it is to be understood that the surfactants described above can be used with or without any nonionic surfactant and individually or in combination.

Preferably, the surfactant is a nonionic surfactant such as an ethoxylated alcohol, as described above. Nonionic surfactants of this type include the NEODOL™ products, e.g., Neodol 23-6.5, Neodol 25-7, and Neodol 25-9 which are respectively, a $C_{12-13}$ linear primary alcohol ethoxylate having 6.5 moles of ethylene oxide, a $C_{12-15}$ linear primary alcohol ethoxylate having 7 moles of ethylene oxide, and a $C_{12-15}$ linear primary alcohol ethoxylate having 9 moles of ethylene oxide.

Desirably, the ratio of sodium carbonate to surfactant is from about 2:1 to about 3.5:1. Preferably, the ratio is from about 2.2:1 to about 3.3:1, more preferably from about 2.3:1 to about 2.8:1. In the most preferred embodiment the ratio of sodium carbonate to nonionic surfactant is about 2.4:1.

The surfactants are therefore incorporated in an amount of about 5% to about 50% by weight of the final product. Of course, the detergent benefits of high surfactant concentration must be balanced against cost-performance. Therefore, the preferred range for the surfactants is from about 20% to about 40% by weight of the final product, more preferably, from about 20% to about 30%. Most preferably, the surfactant is present at a level of about 25%. It should be mentioned that within the above ranges the lower levels tend to be required under conditions of use at higher product concentrations, as is commonly the practice in Europe, and the converse applies under conditions of use at lower product concentrations, as tends to occur in North America and Asia.

In a preferred embodiment, from about 5% to about 80% sodium carbonate is blended with from about 5% to about 50% of a nonionic surfactant, wherein the nonionic surfactant is the sole surfactant present, to form a form a premix comprising a homogeneous mixture of nonionic surfactant coated sodium carbonate. More preferably, the premix is formed by blending from about 20% to about 70% of sodium carbonate with up to about 5%, preferably from about 0.5% to about 4% of silica, and from about 1% to about 3% of minor detergent ingredients including carboxymethylcellulose and, loading the sodium carbonate, silica, and carboxymethylcellulose with from about 20% to about 40% of a nonionic surfactant wherein the nonionic surfactant is the sole surfactant present in the premix. In a more preferred embodiment, the premix is formed by mixing from about 30% to about 65% of sodium carbonate, from about 0.5% to about 4% of a silica, from about 2% to about 3% of carboxymethylcellulose, and a minor amount of other optional detergent ingredients; and spraying from about 20% to about 30% of a nonionic surfactant wherein the nonionic surfactant is the sole detergent surfactant present, onto the mixed carbonate, silica, carboxymethylcellulose, and optional ingredients.

Loading, adsorption, and absorption of the surfactant onto the sodium carbonate (and into its porous structure) can be achieved by, for example, simple admixture with sufficient agitation to distribute the nonionic surfactant entirely on and within the sodium carbonate to form a premix comprising a homogeneous mixture of surfactant coated sodium carbonate. As used herein, "coated" includes absorption into the carbonate particles. The loading can be accomplished in any of the known mixers such as by a ribbon or plow blender. Preferably, the surfactant is sprayed onto the sodium carbonate and other optional ingredients, if present, while they are agitated. In preparing the premix of the present invention, it is important that the sodium carbonate is sufficiently coated with the surfactant so that when water is later added, the water does not immediately contact uncoated carbonate and hydrate the carbonate. It is believed that excessive hydration of the carbonate reduces the amount of water available to solubilize the carboxylic acid which will require additional water to achieve the desired agglomerated particle size.

At the same time, if an excess amount of surfactant is present in the premix, the later admixed carboxylic acid may be coated with the excess surfactant. As a result, the amount of carboxylic acid available to solubilize and neutralize with the sodium carbonate will be reduced, which, in turn will reduce the agglomeration efficiency and require additional carboxylic acid to achieve the desired particle size.

As discussed above, the surfactant is added in an amount so that it is within a particular ratio with respect to the sodium carbonate. Within this ratio range, the surfactant adequately coats the sodium carbonate yet does not provide a substantial excess of surfactant which would then undesirably coat the carboxylic acid. Moreover, it is believed that the order of addition is important to achieving the desired agglomeration. By loading the sodium carbonate with the surfactant prior to the admixture of carboxylic acid and introduction of water, the desired particle size is achieved while still producing a free-flowing powder.

The third essential ingredient is the sodium salt of a carboxylic acid wherein the carboxylic acid is selected from those carboxylic acids that, below a first temperature, have a greater water solubility than the water solubility of its corresponding sodium salt. As will be discussed below, the first temperature is from about 15° C. to about 40° C. Preferably, the sodium carboxylate is provided solely by the reaction of the corresponding carboxylic acid and the sodium carbonate. Preferred sodium carboxylates are selected from the group consisting of sodium citrate, sodium malate, and mixtures thereof. Sodium citrate is the most preferred because citric acid is relatively inexpensive and is readily obtainable.

The sodium carboxylate is present in the detergent composition at a level of up to about 25%, preferably from about 4% to about 18% and is provided solely by the reaction of the carboxylic acid and the sodium carbonate. It is believed that when the amount of sodium carboxylate is within this range, the desired agglomeration of the surfactant loaded sodium carbonate will be efficiently achieved and will produce the desired particle size. More preferably, the sodium carboxylate is present at a level of from about 5% to about 13% and in the most preferred embodiment is present at a level of about 9% to about 11%.

Desirably, as will be further discussed below, the carboxylic acid should be substantially completely neutralized by reaction with the sodium carbonate to its corresponding sodium salt during processing. For example, malic acid should be substantially completely neutralized to sodium malate. Because of reaction and processing limitations, it is believed that the carboxylic acid is not completely neutralized. Therefore, it is desirable to neutralize at least about 90%, preferably at least about 95% and more preferably at least about 99% of the carboxylic acid to its sodium carboxylate. Preferably, the substantially completely neutralized carboxylic acid will be selected from the group consisting of the sodium salts of citric acid, malic acid, and mixtures thereof.

The amount of carboxylic acid to be admixed can be determined from the amount of substantially completely neutralized carboxylic acid desired in the final product as well as the amount of sodium carbonate present. It would be desirable to use the minimum amount of carboxylic acid necessary to achieve acceptable agglomeration. This amount, however, must be balanced against the desire to provide an amount of the sodium carboxylate in the final product sufficient to control hard water filming in those instances where hard water is used. Acid levels which are too high can result in lower alkalinity by neutralization of the sodium carbonate which can detrimentally affect detergent performance. Too little acid, on the other hand, reduces the ability of the acid salt hydrate to entrap the added moisture and hampers agglomeration. The carboxylic acid is therefore incorporated in an amount such that the ratio between the sodium carbonate and the carboxylic acid is in the range from about 6.5:1 to about 12:1, preferably in the range from about 6.5:1 to about 8:1, more preferably about 7:1.

The carboxylic acid is admixed with the premix at a level of up to about 18% by weight of the final product. The preferred range of admixed acid is from about 3% to about 13% by weight of the final product, more preferably from about 4% to about 10% and most preferably from about 7% to about 9%. The carboxylic acid is only lightly admixed with the premix prior to the later introduction of water to minimize the potential for coating of the carboxylic acid by the nonionic surfactant.

After the carboxylic acid is lightly admixed with the premix, a small amount of water is incorporated to accomplish agglomeration of the particles. The water may be incorporated as a mist, steam, or in another suitable fashion. Desirably, the amount of water used is as small as practical in order to minimize subsequent drying time, energy and thus cost. The water is therefore incorporated at a level of no more than about 7%, preferably no more than about 5%. In a more preferred embodiment, the water is incorporated in a range between about 4% and about 5%.

The water is incorporated into the mixture using any suitable mixing apparatus to achieve agglomeration of the mixture. Preferably, a drum agglomerator is used. The agglomerator rotates to distribute the mixture along the length of the drum as the falling sheets of the mixture are sprayed with water to produce a well controlled agglomeration of the particles.

Without wishing to be bound by any particular theory, it is believed that the carboxylic acid is solubilized and neutralized by the sodium carbonate at the same time the sodium carbonate is hydrated. The carboxylic acid should be substantially completely neutralized to its corresponding sodium salt which, below a first temperature, is less water soluble than the acid form. During the neutralization of the carboxylic acid, the sodium carboxylate binds the surfactant coated sodium carbonate particles to agglomerate them and to produce the desired particle size. As the drum rotates and the particles are agglomerated, the larger particles move from the inlet end to the outlet end of th e agglomerator where they exit and are conveyed to a dryer to remove the free water from the agglomerated particles. The agglomerator is preferably inclined from the inlet to the outlet so that as the particles agglomerate, the larger agglomerated particles move from the inlet end to the outlet end where they are conveyed to an air dryer to be dried.

In particular, while not wishing to be held to a specific theory, it is believed that the carboxylic acid is solubilized with the water and reacts with the sodium carbonate to become substantially completely neutralized. The salts of the carboxylic acids, for example, citric and malic, have a water solubility less than their acid form below a first temperature and therefore the s alts come out of solution to bind and thus agglomerate the particles. As noted above, insufficient coating by the surfactant on the surface of the sodium carbonate will produce excessive hydration of the sodium carbonate. As a result, the water required to solubilize the carboxylic acid will not be available and additional water and processing time will be required to produce the desired agglomerated particle size. In addition, hydration of sodium carbonate is exothermic and excessive hydration of sodium carbonate will generate undesirable heat and increase the temperature of the mixture above the first temperature. At the same time, an excess of surfactant present in the premix may cause coating of the carboxylic acid resulting in a reduction of agglomeration efficiency. In addition, additional carboxylic acid and water may be required to achieve the desired agglomerated particle size. Consequently, the order of addition as well as the temperature are believed to be important to achieving the desired agglomeration and particle size.

It is believed that by adding the carboxylic acid after the premix has been formed, the desired solubilization of the carboxylic acid is achieved prior to a substantial reaction with the sodium carbonate. If the citric acid were admixed with the sodium carbonate prior to adding the surfactant, it is believed that the resulting product would not achieve the desired free flowing and dissolution properties.

As noted above, the preferred carboxylic acid has a greater water solubility than its corresponding sodium salt below a first temperature. An increase in temperature above the first temperature therefore adversely affects the relative solubility of the acid form of the carboxylic acid in comparison to the salt form which, in turn, adversely affects the agglomeration efficiency. As a result, the formation of the sodium salt of the carboxylic acid is controlled so as to prevent the temperature of the mixture from rising above the first temperature.

Generally, the first temperature can range from about 15° C. to about 40° C., preferably from about 32° C. to about 35° C. A first temperature higher than about 42° C. appears to adversely affect the product characteristics and is, therefore, undesirable.

It will be understood by one skilled in the art that several factors can be varied to control the residence time (i.e., the weight of the mixture on the bed divided by the total feed rate) and agglomerate size, e.g., feed rate to the drum, angle of the drum, rotational speed of the drum, the number and location of the water spray. The result of manipulating such factors is desired control of the particle size and density of the agglomerates that sent to the dryer.

The wetted agglomerated particles are dried to remove any free water. The drying may be accomplished by any known method such as by a tumbling dryer or air drying on a conveyor. As one skilled in the art will appreciate, the time, temperature, and air flow may be adjusted to provide for an acceptable drying rate. Using a high ambient temperature in the dryer can shorten the residence time in the dryer, while lower temperatures may unduly lengthen the residence time. Short residence times, however, may increase the risk of adversely affecting the stability of the agglomerates or of incompletely drying the agglomerate.

It is desirable to remove as much water as practicable since the presence of water, even when bound, may detrimentally react with post-added moisture sensitive detergent ingredients such as bleaches and enzymes. In addition, the presence of water may, over time and under typical storage conditions, cause product caking. Therefore, in a preferred embodiment, a minor amount of water is added to accomplish agglomeration and furthermore, at least about 50% of the added water is removed by drying. More preferably, at least about 60% of the added water is removed by drying. Consequently, the resulting composition contains less than about 3% of bound water, more preferably less than about 2% of bound water.

The dried particles have an average particle mesh size of up to about 20 U.S. Standard Sieve number. Preferably, the particles have a particle mesh size such that about 90% of the particles are in the range from about 20 to about 100 U.S. Standard Sieve number. The resulting powder has a bulk density of at least 0.7 g/cc, preferably from about 0.8 to about 0.9 g/cc, more preferably from about 0.85 to about 0.9 g/cc.

The mixing steps in the process to prepare the detergent compositions of this preferred embodiment can be accomplished with a variety of mixers known in the art. For example, simple, paddle or ribbon mixers are quite effective although other mixers, such as drum agglomerators, fluidized beds, pan agglomerators and high shear mixers may be used.

In accordance with the present invention, the whitening agent particles are added to the dried powder detergent. Preferably, the whitening agent particles are post-added to the detergent. In this context, post-added refers to adding the particles to the detergent after it has been dried, e.g. by spray drying or other method, and is ready to be packaged.

In one form of the present invention, the whitening agent particles comprise a whitening agent and a surfactant, preferably, an anionic surfactant. In another, more preferred form, the whitening agent particles comprise a whitening agent, a surfactant, and water. Incorporation of the discrete whitening agent particles in accordance with the present invention results at least in a stabilizing of the appearance of the laundry detergent powder. The often observed greenish or yellowish discoloration of the detergent caused by degradation of the typical addition of fluorescent whitener can thus be reduced if not alleviated.

The composition is preferably in the form of a particle. The whitening agent particles comprise from about 50% to about 95% of a surfactant, from about 1% to about 50% of a whitener and, optionally from about 0.1% up to about 10% of a plasticizer wherein the surfactant is mixed with the whitener in a ratio of surfactant to whitening agent from about 1:1 to about 50:1, preferably from about 1:1 to about 25:1. It is believed that by providing at least an equal amount of surfactant and whitening agent the surfactant will substantially isolate or protect the whitening agent.

The amount of the whitening agent particles added to the laundry detergent depends upon the amount of whitening desired and the amount of nonionic surfactants present in the laundry detergent. However, the amount must be balanced against the cost of the whitening agent. Generally, the amount of the whitening agent particles added to the detergent is from about 0.1% up to about 30%, preferably up to about 15%, and more preferably up to about 5%, of discrete whitening agent particles. Within this range the whitening agent particles are added in a ratio of nonionic surfactant to whitening agent particles in the range of about 2:1 to about 40:1, preferably from about 4:1 to about 25:1, more preferably about 7:1.

Among the whitening agents suitable for use within the scope of this invention are the fluorescent whitening agents. It is also believed that the whiteners disclosed in U.S. Pat. Nos. 4,294,711, 5,225,100, 4,298,490, 4,309,316, 4,411,803, 4,142,044, and 4,478,598 incorporated herein by reference may also be useful in the present invention. Preferably, the whitening agents are selected from those fluorescent whitening agents consisting of coumarins, diaminostilbenedisulfonic acids, diaminostilbenesulfonic acid-cyanuric chlorides, distyrylbiphenyls, naphthotriazoylstilbenes, and pyrazolines, and mixtures thereof. The coumarin type of whitening agents have the general formula:

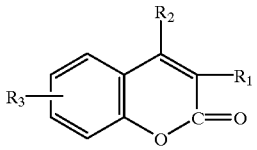

These coumarin whitening agents include 7-dimethylamino-4-methylcoumarin and 7-diethylamino-4-methylcoumarin.

The diaminostilbenesulfonic acid-cyanuric chlorides have the general formula:

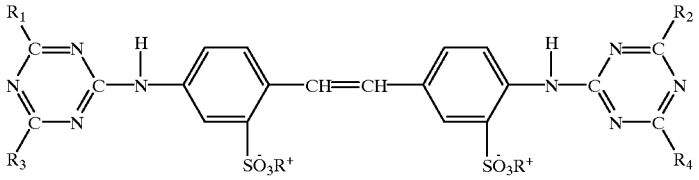

$R^+ = H^+, Na^+, K^+$, etc.

The diaminostilbenesulfonic acid-cyanuric chlorides include the 4,4N-Bis[(4,6-dianilino-s-triazin-2-yl)amino]-2,2N stilbenedisulfonic acids, or their alkali metal or alkanolamino salts, in which the substituted group is either morpholine, hydroxyethyl methylamino, dihydroxyethylamino or methylamino; the 4,4N-Bis{{(4-anilino-6-[bis(2-hydroxyethyl)amino]-s-triazin-2-yl}amino}-2,2N-stilbenedisulfonic acids; the 4,4N-Bis[(4-anilino-6-morpholino-s-triazin-2-yl)amino]-2,2N-stilbenedisulfonic acids; the 4,4N-Bis[[4-anilino-6[N-2-hydroxyethyl-N-methylamino]-s]triazin-2-yl]amino]-2,2N-stilbenesulfonic acid disodium salts; and the 4,4N-Bis[[4-anilino-6-[(2-hydroxylpropyl)amino]-s-triazin-2-yl]amino]-2,2Nstilbenedisulfonic acid disodium salts.

The distyrylbiphenyl whitening agents have the general formula:

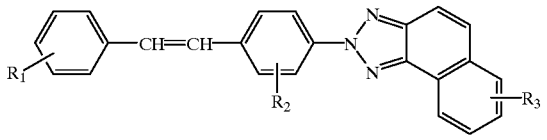

The distyrylbiphenyl whitening agents include the 2,2-(4,4N-Biphenylene divinylene)-dibenzenesulfonic acid, disodium salts. For example, Tinopal CBS (Ciba-Geigy) which is disodium 2,2N-bis-(phenyl-styrl) disulphonate may be useful. The 4-Benzooxazolyl-4N-oxadiazolyl stilbenes as disclosed in U.S. Pat. No. 4,142,044, the entire disclosure of which is hereby incorporated by reference, may also be suitable for use in the present invention.

The naphthotriazoylstilbene type whitening agents have the general formula:

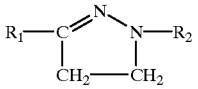

The naphthotriazoylstilbene type whitening agents include the 4-(2H-Naphtho[1,2-d]triazol-2-yl)-2-stilbenedisulfonic acid, sodium salts.

The pyrazoline type whitening agents have the general formula:

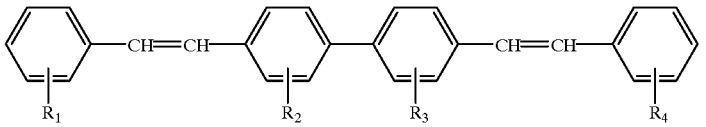

The pyrazoline type whitening agents include the p-[3-(p-Chlorophenyl)-2-pyrazolin-1yl]-benzenesulfonamides.

Preferably, the whitening agent is selected from the group consisting of the derivatives of disulfonated diaminostilbene/cyanuric chloride whiteners which have the general formula:

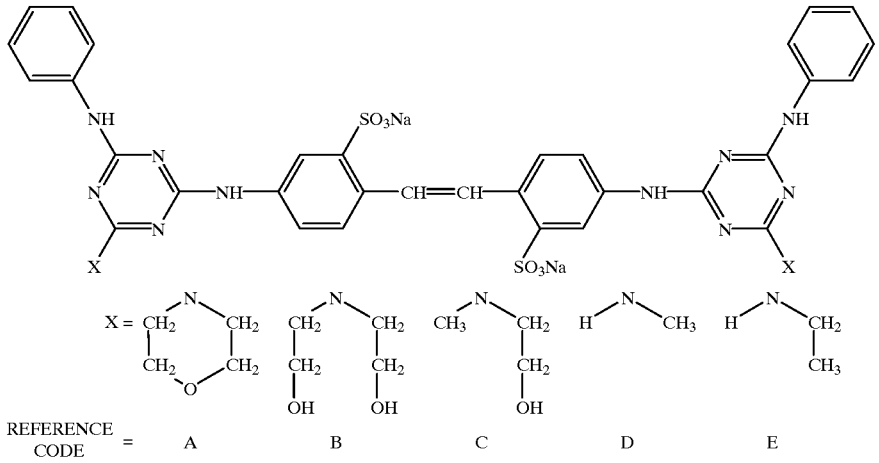

More preferably, the whitener is selected from the group of disulfonated diaminostilbene/cyanuric chloride whiteners wherein X has the formula A or C. An example of a whitener wherein X has the formula shown in A is the whitener marketed under the tradename Optiblanc 2M/G (by 3V Chemical Corp). When the 2M/G whitener is used, preferably the 2M/G LT version is used. An example of a whitener wherein X has the formula shown in C is Tinopal 5BM-GX.

In the form where the whitening agent particle comprises a whitener and a surfactant, the surfactant for the whitening agent particle is selected to be compatible with detergent surfactants that are typically included in laundry detergents. Preferably, the particle surfactant is selected from the group consisting of those anionics, nonionics, zwitterionics, ampholytics, cationics, and mixtures thereof that are solids in a temperature range of from about 32° F. (0° C.) to about 180° F. (82° C.). Suitable surfactants are fully described above as well as in the literature, for example in "Surface Active Agents and Detergents" Volumes I and II by Schwartz, Perry & Berch in "Nonionic Surfactants" by M. J. Schick, and in McCutcheon's "Emulsifiers & Detergents," each of which are incorporated herein by reference.

It will be appreciated that by using a surfactant for the whitening agent particles, the cleaning ability of the laundry detergent will not be hindered and may indeed be augmented by the presence of additional surfactant, particularly if the particle surfactant is an anionic surfactant. Moreover, by using a surfactant, the end product particles have an acceptable solubility in an aqueous medium, particularly a laundering solution.

The surfactants described above for the detergent may be useful in preparing the whitener particle so long as they are a solid in a temperature range of from about 32° F. (0° C.) to about 180° F. (82° C.). For example, it may be possible to use alkyl saccharides or highly ethoxylated acids or alcohols (e.g. those having from about 30 to about 80 moles of ethylene oxide per mole of acid or alcohol). Of course it will be understood by one skilled in the art that the nonionic surfactants will be less desirable as compared to the anionic surfactants since nonionic surfactants generally affect not only the stability of the whitener but also the ability of the whitener to effectively deposit on the fabric.

With the foregoing considerations in mind, nonionic surfactants may be useful in the instant composition. Such nonionic materials include compounds produced by the condensation of alkylene oxide groups (hydrophilic in nature) with an organic hydrophobic compound, which may be aliphatic or alkyl aromatic in nature. Such nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol, with the higher ethylene oxide amounts being preferred.

Included are the water-soluble and water-dispersible condensation products of aliphatic alcohols containing from 9 to 22 carbon atoms, in either straight chain or branched configuration, with from greater than 12 moles of ethylene oxide per mole of alcohol. For example, preferred nonionic surfactants have the general formula $R^1(OC_2H_4)_nOH$, where $R^1$ is a $C_8$–$C_{20}$ alkyl group or a $C_8$–$C_{12}$ alkyl phenyl group, and n is from 12 to about 80.

Alkyl saccharides may also find use in the composition. In general, the alkyl saccharides are those having a hydrophobic group containing from about 8 to about 20 carbon atoms, preferably from about 10 to about 16 carbon atoms, and a polysaccharide hydrophilic group containing from about 1 (mono) to about 10 (poly), saccharide units (e.g., galactoside, glucoside, fructoside, glucosyl, fructosyl, and/or galactosyl units). Mixtures of saccharide moieties may be used in the alkyl saccharide surfactants. Preferably, the alkyl saccharides are the alkyl glucosides having the formula $$R^1O(C_NH_{2N}O)_t(Z)_X$$

wherein Z is derived from glucose, $R^1$ is a hydrophobic group selected from the group consisting of alkyl, alkyl-phenyl, hydroxyalkyl, hydroxyalkylphenyl, and mixtures thereof in which the alkyl groups contain from about 10 to about 18 carbon atoms, n is 2 or 3, t is from 0 to about 10, and x is from 1 to about 8. Examples of such alkyl saccharides are described in U.S. Pat. No. 4,565,647 (at col. 2, line 25 through col. 3, line 57) and U.S. Pat. No. 4,732,704 (at col. 2, lines 15–25), the pertinent portions of each are incorporated herein by reference.

It has, however, been found that when the detergent surfactants comprising the laundry detergent include a substantial amount of nonionic surfactant, the surfactant in the whitening agent particle is preferably an anionic surfactant. More particularly, in the more preferred embodiment when a nonionic surfactant is the sole detergent surfactant, the particle surfactant is advantageously an anionic surfactant. Useful anionic surfactants include all the anionic surfactants described above.

Thus useful anionic surfactants include the water-soluble salts of the higher fatty acids, i.e., soaps. This includes alkali metal soaps such as the sodium, potassium, ammonium, and alkyl ammonium salts of higher fatty acids containing from about 8 to about 24 carbon atoms. Soaps can be made by direct saponification of fats and oils or by the neutralization of free fatty acids. Particularly useful are the sodium and potassium salts of the mixtures of fatty acids.

Useful anionic surfactants also include the water-soluble salts, preferably the alkali metal, ammonium and alkylolammonium salts, of organic sulfuric reaction products having in their molecular structure an alkyl group containing from about 8 to about 20 carbon atoms and a sulfonic acid or sulfuric acid ester group. Included in the term "alkyl" is the alkyl portion of acyl groups. Examples of this group of synthetic surfactants are the sodium and potassium alkyl sulfates, especially those obtained by sulfating the higher primary or secondary alcohols ($C_8$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. No. 2,220,099 and alkylbenzene sulfonates in which the average number of carbon atoms in the alkyl group is from about 11 to 14, abbreviated as $C_{11-14}$ LAS. Preferably, the anionic surfactant is a sodium alkyl sulfate, wherein the alkyl portion has from about 8 to about 20 carbon atoms, such as, for example, sodium lauryl sulfate.

The anionic surfactants useful in the present invention may also include the potassium, sodium, calcium, magnesium, ammonium or lower alkanolammonium, such as triethanolammonium, monoethanolammonium, or diisopropanolammonium paraffin or olefin sulfonates in which the alkyl group contains from about 10 to about 20 carbon atoms. The lower alkanol of such alkanolammonium will normally be of 2 to 4 carbon atoms and is preferably ethanol. The alkyl group can be straight or branched and, in addition, the sulfonate is preferably joined to any secondary carbon atom, i.e., the sulfonate is not terminally joined.

Other anionic surfactants that may be useful in the present invention include the secondary alkyl sulfates having the general formula:

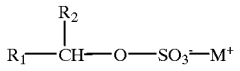

wherein M is potassium, sodium, calcium, or magnesium, $R_1$ represents an alkyl group having from about 3 to about 18 carbon atoms and $R_2$ represents an alkyl group having from about 1 to about 6 carbon atoms. Preferably, M is sodium, $R_1$ is an alkyl group having from about 10 to about 16 carbon atoms, and $R_2$ is an alkyl group having from about 1 to about 2 carbon atoms.

Other anionic surfactants useful herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl group contains from about 10 to about 20 carbon atoms.

The ether sulfates useful in the present invention are those having the formula $RO(C_2H_4O)_xSO_3M$ wherein R is alkyl or alkenyl having from about 10 to about 20 carbon atoms, x is 1 to 30, and M is a water-soluble cation preferably sodium. Preferably, R has 10 to 16 carbon atoms. The alcohols can be derived from natural fats, e.g., coconut oil or tallow, or can be synthetic. Such alcohols are reacted with 1 to 30, and especially 1 to 12, molar proportions of ethylene oxide and the resulting mixture of molecular species is sulfated and neutralized.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Another example of anionic surfactants that may be useful in the present invention are those compounds which contain two anionic functional groups. These are referred to as di-anionic surfactants. Suitable di-anionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyidisulfates and 6,10-octadecyldisulfates.

Preferably, the anionic surfactant is a sodium alkyl sulfate, wherein the alkyl portion has from about 8 to about 20 carbon atoms, such as, for example, sodium lauryl sulfate.

The whitener and particle surfactant are mixed in a ratio of surfactant to whitening agent from about 1:1 to about 50:1, preferably from about 1:1 to about 25:1. More preferably, the ratio of surfactant to whitening agent is in the range from about 2:1 to about 10:1 with the most preferable range being from about 2:1 to about 5:1. It is believed that, by providing at least an equal amount of surfactant and whitening agent that in the resulting particles, the surfactant will substantially isolate or protect the whitening agent from the deleterious effects of any nonionic surfactant present.

Optionally, a plasticizer may be included in the present composition in an amount to provide for a softer or more pliable end product. The plasticizer may be any of the well known plasticizers in the extrusion art such as water, mineral oil, fatty alcohols, fatty acids, alkoxylated fatty acids, alkoxylated alcohols, including the salts of the fatty alcohols, fatty acids, alkoxylated fatty acids, and alkoxylated alcohols, and the like, and mixtures thereof.

Surprisingly, it has been found that nonionic surfactants are desirable plasticizing agents and may include the nonionic surfactants described above. In particular, the nonionic surfactants having the formula $R^1(OC_2H_4)_nOH$, where $R^1$ is a $C_8$–$C_{18}$ alkyl group or a $C_8$–$C_{12}$ alkyl phenyl group, and n is from 3 to about 80 are preferred. Particularly preferred nonionic surfactants are the condensation products of $C_{10}$–$C_{16}$ alcohols with from about 5 to about 20 moles of ethylene oxide per mole of alcohol, e.g., a $C_{12}$–$C_{15}$ alcohol condensed with about 6 to about 9 moles of ethylene oxide per mole of alcohol. Nonionic surfactants of this type include the NEODOL™ products, e.g., Neodol 23-6.5, Neodol 25-7, and Neodol 25-9 which are, respectively, a $C_{12-13}$ linear primary alcohol ethoxylate having 6.5 moles of ethylene oxide, a $C_{12-15}$ linear primary alcohol ethoxylate having 7 moles of ethylene oxide, and a $C_{12-15}$ linear primary alcohol ethoxylate having 9 moles of ethylene oxide.

When a plasticizer is included in the whitening agent particle composition of the present invention, it is incorporated at a level from about 0.1% to no more than about 10% of the whitening agent particle end product. If too much plasticizer is included, the resulting end product may be too pliable to be effectively admixed into the detergent. Preferably, the plasticizer is included at a level from about 0.1% to no more than about 5%, more preferably no more than about 3% of the whitening agent end product. At these levels the ratio of surfactant to plasticizer is at least about 2:1. Preferably, the ratio of surfactant to plasticizer is from at least about 5:1 up to about 50:1, more preferably from about 20:1 to about 40:1, and most preferably from about 30:1 to about 40:1.

Other typical detergent ingredients may also be included in the whitening agent particle so long as they do not deter from the sought after advantage resulting from forming the whitening agent into a discrete particle. In particular, such detergent ingredients as silicones, defoamers, citric acid, sodium carbonate, phosphates, and other builders may be incorporated in the mixture.

It has now been found that a whitening agent particle that consists of a whitening agent, a surfactant, preferably an anionic surfactant, and water is particularly effective. In this form, the whitening agent particle comprises from about 50% to about 95% of a surfactant, from about 1% to about 50% of a whitener, and from about 0.1% up to about 10% of water. Preferably, the surfactant is mixed with the whitener in a ratio of surfactant to whitening agent from about 1:1 to about 50:1, preferably from about 1:1 to about 25:1, more preferably from about 1:1 to about 5:1, most preferably from about 2:1 to about 3:1. Also, the water, as a plasticizer, is added in a ratio of surfactant to water from about 5:1 to about 70:1, preferably from about 20:1 to about 40:1, more preferably from about 30:1 to about 40:1.

To prepare the whitening agent particles, the whitener and surfactant, and, optionally the plasticizer, are mixed in the desired amounts to form a substantially homogeneous mass which can be worked according to well known techniques until it is sufficiently "doughy" or plastic to be in suitable form for, preferably, extrusion or other process, e.g., pelleting, granulation, stamping and pressing. As an example, the whitener and surfactant may be charged to a mixer where they are mixed while being sprayed with the plasticizer. The wetted mixture is then formed into discrete particles. Alternatively, the whitener may be continuously metered to a mixing tank separately from the surfactant which is also continuously metered to the mixing tank where the whitener and surfactant are mixed while being sprayed. An amount of the wetted mixture is continuously removed from the mixing tank and formed into discrete particles by, for example, an extrusion process.

It is contemplated that the surfactant could be sprayed onto the whitening agent to encapsulate the whitening agent. However, such a process would require solubilization or dispersion of the surfactant and subsequent drying after spraying the whitening agents, which necessarily requires additional processing steps. In addition, the drying may cause heat degradation of the whitening agent.

Preferably, the mixture is extruded through, for example, a screw type extruder. When the mixture is extruded, it is extruded at a die exit temperature of about 100° F. (38° C.) to about 180° F. (82° C.), preferably at a die exit temperature of about 130° F. (54° C.) to about 160° F. (71° C.). The extrusion die head may be selected in accordance with the desired shape, i.e., geometric form, desired in the extrudate. For example, the extrudate may take the shape of spaghetti or noodles, although other shaped forms such as flakes, tablets, pellets, ribbons, threads and the like are suitable alternatives. To provide a particle wherein the whitening agent is sufficiently protected, the die slot is preferably shaped so that the extrudate takes the shape of spaghetti. In this preferred shape, the die slot has a diameter of about 0.1 mm to about 5 mm with a preferred range of from about 0.5 mm to about 2.5 mm, more preferably from about 0.5 mm to about 1.5 mm. The die slot diameter determines the diameter of the resulting particle and in the process of the present invention the diameter of the resulting particle is approximately the same as the die slot diameter. Therefore, the particles of the present invention have a diameter of about 0.1 mm to about 5 mm with a preferred range of from about 0.5 mm to about 2.5 mm, more preferably from about 0.5 mm to about 1.5 mm. Die slot diameters greater than about 5 mm will produce particles having a reduced dissolution rate as compared to those within the preferred range.

The spaghetti has an average length from about 0.1 mm to about 30 mm with about 95% thereof within a tolerance of about 0.5 mm to about 20 mm. More preferably, the spaghetti has an average length from about 0.5 mm to about 10 mm. Most preferably, the average length is from about 1 to about 3 mm. An excessive length may lead to segregation of the particles during use. At the same time, an excessively short length may increase the total surface area of the extrudate which may cause increased surface dusting and bleeding of color from the whitening agent particles.

In a preferred embodiment, the whitening agent composition consists essentially of a whitening agent, a surfactant and, optionally a plasticizer, wherein the whitening agent, surfactant and plasticizer are those described above. In this preferred embodiment, it is desirable to exclude those additional ingredients that may adversely affect the solubility or stability of whitening agent. In a more preferred embodiment, the whitening agent composition consists only of a whitening agent, a surfactant and, optionally a plasticizer wherein the whitening agent, surfactant and plasticizer are those described above.

This preferred composition is made by a process that comprises the steps of preparing a homogenous mass consisting essentially of a whitening agent, a surfactant, and, optionally a plasticizer, wherein the whitening agent, surfactant and plasticizer are those described above; extruding the mass through a die extruder at an elevated temperature to provide an extrudate in the shape of spaghetti particles. In this preferred embodiment, it is desirable to exclude those additional ingredients that may adversely affect the solubility or stability of whitening agent. In a more preferred embodiment, the homogenous mass consists only of the essential ingredients; a whitening agent, a surfactant and, optionally a plasticizer wherein the whitening agent, surfactant and plasticizer are those described above.

In a preferred embodiment, the whitening agent and anionic surfactant are mixed while the plasticizer is sprayed onto the mixture. Thereafter, the resulting mixture is fed into a pressurized extruder, for example, a screw extruder, where the mixture is extruded into the desired shape. Alternatively, the whitening agent and anionic surfactant may be separately fed to a mixer where they are mixed while being sprayed with the plasticizer, preferably the nonionic surfactant and more preferably.

The detergent composition thus comprises an agglomerated powder detergent that comprises from about 30% to about 60% of sodium carbonate and, from about 20% to about 40% of a nonionic surfactant, wherein the nonionic surfactant is the sole surfactant present in the agglomerated powder detergent, and from about 0.1% up to about 10% of discrete whitening agent particles wherein the whitening agent particles comprise in one form a whitener and a surfactant or in another form a whitener, a surfactant, and water such that the particle substantially completely protects the whitening agent from degradation.

The following examples are for illustrative purposes only and are not to be construed as limiting the invention.

EXAMPLES 1–15

Examples 1–15 in Tables 1–4 show a number of formulations to outline the scope of the whitening agent particles that may be useful in the present invention. Examples 1–10 show various types of anionic surfactants as well as whiteners to illustrate the range of surfactants and whiteners. Examples 12–15 show possible adjuncts to the particle compositions. Each of the compositions in Examples 1–15 were prepared by mixing each of the ingredients and then extruding them through a one inch extruder having mixing pins (Bonnot Co.).

TABLE 1

| Example No. | 1 | 2 | 3 | 4 |
|---|---|---|---|---|
| Sodium paraffin sulfate | 50 | — | — | — |
| Sodium lauryl sulfate | — | 50 | 50 | 50 |
| Tinopal CBS-X | 50 | 50 | 25 | — |
| Tinopal UNPA-GX | — | — | 25 | — |
| Optiblanc 2M/G LT | — | — | — | 50 |

TABLE 2

| Example No. | 5 | 6 | 7 | 8 |
|---|---|---|---|---|
| Sodium lauryl sulfate | 75 | 80 | 75 | 75 |
| Tinopal UNPA-GX | 25 | 20 | — | — |
| Tinopal CBS-X | — | — | 25 | — |
| Optiblanc 2M/G LT | — | — | — | 25 |

TABLE 3

| Example No. | 9 | 10 | 11 |
|---|---|---|---|
| Sodium stearate | 78 | 75 | 75 |
| Tinopal 5BM-GX | 22 | — | — |
| Tinopal CBS-X | — | 25 | — |
| Optiblanc 2M/G LT | — | — | 25 |

TABLE 4

| Example No. | 12 | 13 | 14 | 15 |
|---|---|---|---|---|
| Sodium lauryl sulfate | 50 | 60 | 70 | 72.5 |
| Sodium carbonate | 22.5 | 10 | 12.5 | 10 |

TABLE 4-continued

| Example No. | 12 | 13 | 14 | 15 |
|---|---|---|---|---|
| Tinopal CBS-X | 20 | 22.5 | 10 | 10 |
| Fumaric acid | 7.5 | 7.5 | 7.5 | 7.5 |

In the following examples, the color of the detergent particles is measured to provide a Whiteness Index which can provide an indication of the degradation of the whitening agent. The color is measured using a sphere spectrophotometer Model SP68™ by X-Rite® to provide a Whiteness Index. The use of such a spectrophotometer is known to those skilled in the art. In general, several readings of the tested material are taken and then averaged to provide an average Whiteness Index. The higher value of the Whiteness Index, the whiter the sample and, therefore, the less degradation of the whitener.

EXAMPLE 16

In the following example, a powder detergent containing whitening agent particles according to the present invention was tested to determine if the detergent exhibited undesirable color degradation. The detergent comprised 53.18% of sodium carbonate, 3% of silica, 2% of carboxymethylcellulose, 22% of Pareth 25-7 (a $C_{12}$–$C_{15}$ alcohol ethoxylated with 7 moles of ethylene oxide), 7.5% of citric acid for agglomeration, 4% of added water (of which 2.5% was removed by drying), 5% of post added acidulant (fumaric acid), 2.22% of detergent ingredients (brightener, fragrance, and enzyme), and 3.6% of a whitener particle that comprised sodium lauryl sulfate and Optiblanc 2M/G LT in a ratio of sodium lauryl sulfate to whitener of 3:1. Table 5 shows the average Whiteness Index at the start of the test, after one-month, and again after three-months at varying conditions.

TABLE 5

| Condition | 40° F. | 70° F./20% RH | 100° F./80% RH | 120° F. |
|---|---|---|---|---|
| Time | | | | |
| Initial | 66.86 | 66.86 | 66.86 | 66.86 |
| 1 month | 70.47 | 64.88 | 45.39 | 43.18 |
| 3 month | 70.33 | 64.87 | 30.62 | 42.06 |

EXAMPLE 17

In the following example, the powder detergent of example 16 was used, except the particles comprised 73% sodium lauryl sulfate, 24% Optiblanc 2M/G LT, and 3% of Neodol 25-7. After 2 months at ambient temperature, the Whiteness Index was 70.85, and at 40° F. the Whiteness Index was 70.62, and at 120° F. the Whiteness Index was 56.90. Although the Whiteness Index after 2 months at 120° F. was less than at ambient temperature, it was still above the acceptable level of about 45.

EXAMPLE 18

In the following example, a powder detergent containing 62.02% sodium carbonate, 2.8% of cellulose gum, 4.4% of sodium silicate, 3% of sodium citrate, 11.05% of a blend of Pareth 25-7 and Pareth 45-7 (a $C_{14}$–$C_{15}$ alcohol ethoxylated with 7 moles of ethylene oxide), 1.7% of Pareth 25-3 (a $C_{12}$–$C_{13}$ alcohol ethoxylated with 3 moles of ethylene oxide), 2.1% of quaternary ammonium chloride, 11% of liquid sodium silicate, 4.88% of detergent ingredients (fragrances, enzymes, sodium hydroxide, dispersant, terpolymer, brightener), loss of 3% of water to drying, and 0.6% of Optiblanc 2M/G LT was tested after 3 weeks and after 6 weeks. The Optiblanc 2M/G LT was simply post-added to the powder detergent and was not formulated into a particle in accordance with the present invention. Table 6 shows the rapid degradation in the bulk color of the detergent when the whitening agent is not formulated as a particle in accordance with the present invention.

TABLE 6

| Condition | 70° F./20% RH | 120° F. |
|---|---|---|
| Time | | |
| Initial | 60.69 | 60.69 |
| 3 weeks | 52.19 | 38.98 |
| 6 weeks | 53.07 | 30.26 |

EXAMPLE 19

In the following example, a powder detergent was prepared containing 52.8% sodium carbonate, 3.3% precipitated silica, 2% cellulose gum, 22% Pareth 25-7 (a $C_{12}$–$C_{15}$ alcohol ethoxylated with an average of 7 moles of ethylene oxide), 7.5% citric acid for agglomeration, 4% of added water for agglomeration (of which 2.37% was removed by drying), 5% post-added acidulant (fumaric acid), 2.1% detergent adjuvants (enzyme and fragrance). To this detergent, 0.9% of Optiblanc 2M/G LT (not in the form of a particle according to the present invention) and 2.7% of sodium lauryl sulfate were separately added and the resulting detergent was stored over a period of three months under different conditions. Specifically, a portion of the detergent was stored at ambient temperature, a portion was stored at 100° F. and 80% relative humidity, and a portion was stored at 120° F. Each portion consisted of three samples (A, B, C).

Likewise, to the above detergent, 3.6% of whitener particles made according to the process of the present invention and comprising 24.5% whitening agent (Optiblanc 2M/G LT), 73.51% sodium lauryl sulfate, and 1.99% water was added and the resulting detergent was stored over a period of three months under different conditions. Specifically, a portion of the detergent was stored at ambient temperature, a portion was stored at 100° F. and 80% relative humidity, and a portion was stored at 120° F. Each portion consisted of three samples (D, E, F).

Table 7 shows the average of five measurements of the Whiteness Index measured in the same manner as described in Example 16, for all of the samples at ambient temperature Table 8 shows the average of five measurements of the Whiteness Index measured in the same manner as described in Example 16 for all of the samples at 100° F. and 80% relative humidity. And Table 9 shows the average of five measurements of the Whiteness Index measured in the same manner as described in Example 16 for all of the samples at 120° F.

As seen by a comparison of the results, when the whitener is formulated into a particle according to the method of the present invention, the whitener does not degrade as quickly as the whitener that is not in the form of a particle according to the present invention. It is noted that values below 45 are considered to be unacceptable, i.e., exhibiting discoloration (degradation of the whitener) in the bulk detergent

TABLE 7

| | (Ambient Temperature) | | | | | |
|---|---|---|---|---|---|---|
| Time/Sample | A | B | C | D | E | F |
| Initial | 86.35 | 86.10 | 85.38 | 90.38 | 93.55 | 91.97 |
| 1 Month | 73.83 | 72.89 | 71.39 | 93.08 | 89.21 | 90.78 |
| 3 Month | 62.13 | 60.59 | 58.77 | 83.21 | 84.92 | 87.40 |

TABLE 8

| | (100° F. and 80% Relative Humidity) | | | | | |
|---|---|---|---|---|---|---|
| Time/Sample | A | B | C | D | E | F |
| Initial | 85.80 | 83.29 | 83.12 | 91.75 | 90.72 | 90.76 |
| 1 Month | 30.25 | 30.20 | 30.55 | 63.61 | 66.52 | 66.86 |
| 3 Month | 18.06 | 14.58 | 14.72 | 49.80 | 50.59 | 49.87 |

TABLE 9

| | (120° F.) | | | | | |
|---|---|---|---|---|---|---|
| Time/Sample | A | B | C | D | E | F |
| Initial | 82.98 | 84.17 | 84.95 | 89.66 | 90.41 | 89.72 |
| 1 Month | 46.62 | 49.13 | 48.70 | 76.09 | 75.73 | 75.01 |
| 3 Month | 42.23 | 42.99 | 45.36 | 72.35 | 71.50 | 67.22 |

As noted above, the detergent compositions of the present invention containing admixed discrete whitening agent particles can be made by providing a powder laundry detergent comprising from about 5% to about 80% of an inorganic carrier and from about 1% to about 90% of a detergent surfactant selected from the group consisting of anionics, nonionics, ampholytics, cationics, and mixtures thereof; and admixing discrete whitening agent particles in an amount from about 0.1% up to about 30% of the detergent composition.

In a preferred embodiment, the inorganic carrier is sodium carbonate, the detergent surfactant is a nonionic surfactant, wherein the nonionic surfactant is the sole detergent surfactant present, and the whitening agent particles comprise a whitening agent and water, wherein the whitening agent is a fluorescent whitening agent selected from the group consisting of consisting of coumarins, diaminostilbenedisulfonic acids, diaminostilbenesulfonic acid-cyanuric chlorides, distyrylbiphenyls, naphthotriazoylstilbenes, and pyrazolines, and mixtures thereof. Alternatively, the whitening agent particles comprise a whitening agent and a surfactant, wherein the surfactant is an anionic surfactant. In this preferred embodiment, the alkali metal carbonate is loaded with the nonionic surfactant, agglomerated, and dried. Thereafter, the discrete whitening agent particles are admixed with the dried, agglomerated detergent powder.

It should be understood that a wide range of changes and modifications can be made to the embodiments described above. It is therefore intended that the foregoing description illustrates rather than limits this invention, and that it is the following claims, including all equivalents, which define this invention.

What is claimed is:

1. A phosphate-free powder laundry detergent composition comprising:

a. from about 70% to about 99% by weight of agglomerated detergent particles comprising from about 5% to about 80% by weight of an alkali metal carbonate and from about 1% to about 90% by weight of a nonionic detergent surfactant, wherein the nonionic surfactant is the sole detergent surfactant present; and b. from about 0.1% to about 30% by weight of the detergent of discrete solid whitening agent particles with the particles comprising from about 1% to about 50% by weight of a whitener; from about 50% to about 95% by weight of a whitening agent surfactant selected from the group consisting of anionics, nonionics, zwitterionics, ampholytics, cationics, and mixtures thereof that are solids in a temperature range of from about 32° F. (0° C.) to about 180° F. (82° C.); and, from about 0.1% to about 10% by weight of water.

2. The powder laundry detergent of claim 1 wherein the whitener is selected from the group consisting of fluorescent whitening agents.

3. The powder laundry detergent of claim 1 wherein the whitener is selected from the group consisting of coumarins, diaminostilbenedisulfonic acids, diaminostilbenesulfonic acid-cyanuric chlorides, distyrylbiphenyls, naphthotriazoylstilbenes, and pyrazolines, and mixtures thereof.

4. The powder laundry detergent of claim 1 wherein the whitener is selected from the group consisting of diaminostilbenedisulfonic acids, diaminostilbenedisulfonic acid-cyanuric chlorides, and mixtures thereof.

5. The powder laundry detergent of claim 1 wherein the whitening agent surfactant is an anionic surfactant.

6. The powder laundry detergent of claim 5 wherein the whitening agent surfactant is selected from the group consisting of alkali metal, ammonium and alkylolammonium salts of organic sulfuric reaction products having in their molecular structure an alkyl group containing from about 8 to about 20 carbon atoms and a sulfonic acid or sulfuric acid ester group.

7. The powder laundry detergent of claim 1 wherein the ratio of whitening agent surfactant to whitener is in the range of about 1:1 to about 50:1.

8. The powder laundry detergent of claim 1 wherein the ratio of whitening agent surfactant to water is from about 5:1 to about 70:1.

9. A process for making a phosphate-free detergent composition comprising:

a. agglomerating a mixture comprising from about 5% to about 80% by weight of sodium carbonate with from about 1% to about 90% by weight of a nonionic detergent surfactant wherein the nonionic detergent surfactant is the sole detergent surfactant present;

b. drying the agglomerated particles to form an agglomerated powder; and c. post-adding from about 0.1% to about 15% by weight of the detergent composition discrete solid whitening agent particles to the agglomerated powder, wherein the particles comprise from about 1% to about 50% by weight of a whitener; from about 50% to about 95% by weight of a whitening agent surfactant selected from the group consisting of anionics, nonionics, zwitterionics, ampholytics, cationics, and mixtures thereof that are solids in a temperature range of from about 32° F. (0° C.) to about 180° F. (82° C.); and, from about 0.1% to about 10% by weight of water.

10. The process of claim 9 wherein the whitener is selected from the group consisting of fluorescent whitening agents.

11. The process of claim 9 wherein the whitener is selected from the group consisting of coumarins, diaminostilbenedisulfonic acids, diaminostilbenesulfonic acid-cyanuric chlorides, distyrylbiphenyls, naphthotriazoylstilbenes, and pyrazolines, and mixtures thereof.

12. The process of claim 9 wherein the whitener is selected from the group consisting of diaminostilbenedisulfonic acids, diaminostilbenedisulfonic acid-cyanuric chlorides, and mixtures thereof.

13. The process of claim 9 wherein the whitening agent surfactant is an anionic surfactant.

14. The process of claim 13 wherein the whitening agent surfactant is selected from the group consisting of alkali metal, ammonium and alkylolammonium salts of organic sulfuric reaction products having in their molecular structure an alkyl group containing from about 8 to about 20 carbon atoms and a sulfonic acid or sulfuric acid ester group.

15. The process of claim 9 wherein the ratio of whitening agent surfactant to whitener is in the range of about 1:1 to about 50:1.

16. The process of claim 9 wherein the ratio of whitening agent surfactant to water is from about 5:1 to about 70:1.

* * * * *